US005518011A

United States Patent [19]

Nash

[11] Patent Number: 5,518,011

[45] Date of Patent: May 21, 1996

[54] HAIR BRAIDING DEVICE AND METHOD

[75] Inventor: Christine R. Nash, Mentor, Ohio

[73] Assignee: Wonder-Weave Corporation, Mentor, Ohio

[21] Appl. No.: 276,253

[22] Filed: Jul. 18, 1994

[51] Int. Cl.[6] ..... A45D 7/02

[52] U.S. Cl. ..... 132/212; 132/200; 132/160

[58] Field of Search ..... 132/200, 150, 132/158, 159, 161, 212, 219; 28/21, 22, 30, 32, 33

[56] References Cited

U.S. PATENT DOCUMENTS

| | | | |
|---|---|---|---|
| 88,811 | 4/1869 | Robertson | 132/161 |
| 613,145 | 10/1898 | Herrick et al. | 132/273 |
| 1,684,362 | 9/1928 | Sawyer | 132/159 |
| 1,724,249 | 8/1929 | Baldwin | 132/223 |
| 1,893,864 | 1/1933 | Kocher | 132/158 |
| 2,035,667 | 3/1936 | Payis et al. | 132/150 |
| 2,930,385 | 3/1960 | Fees . | |
| 3,872,873 | 3/1975 | Tupper . | |
| 3,889,692 | 6/1975 | Redron | 132/210 |
| 4,038,996 | 8/1977 | Eronini et al. | 132/271 |
| 4,345,608 | 8/1982 | Cavaioli et al. . | |
| 4,369,690 | 1/1983 | Sapkus . | |
| 4,522,215 | 6/1985 | Verducci . | |
| 4,993,438 | 2/1991 | Hunt . | |
| 4,996,996 | 3/1991 | Hirsh . | |

FOREIGN PATENT DOCUMENTS

| | | | |
|---|---|---|---|
| 3521878 | 1/1987 | Germany | 132/219 |

OTHER PUBLICATIONS

"Hair Right Now", *Mademoiselle,* Sep. 1975, p. 159.

*Primary Examiner*—John G. Weiss

*Attorney, Agent, or Firm*—Fay, Sharpe, Beall, Fagan, Minnich & McKee

[57] ABSTRACT

A hair braiding appliance comprises an elongated handle member which terminates in a comb base. A plurality of spaced fingers or tines extend from the comb base in substantially parallel relation to one another to define a series of hair receiving slots. Each finger or tine increases in thickness as it extends from the comb base to its midregion and then decreases in thickness to terminate in a curved distal end. Hair is woven through the series of slots in a predetermined sequence to form a braid.

5 Claims, 2 Drawing Sheets

FIG. 1
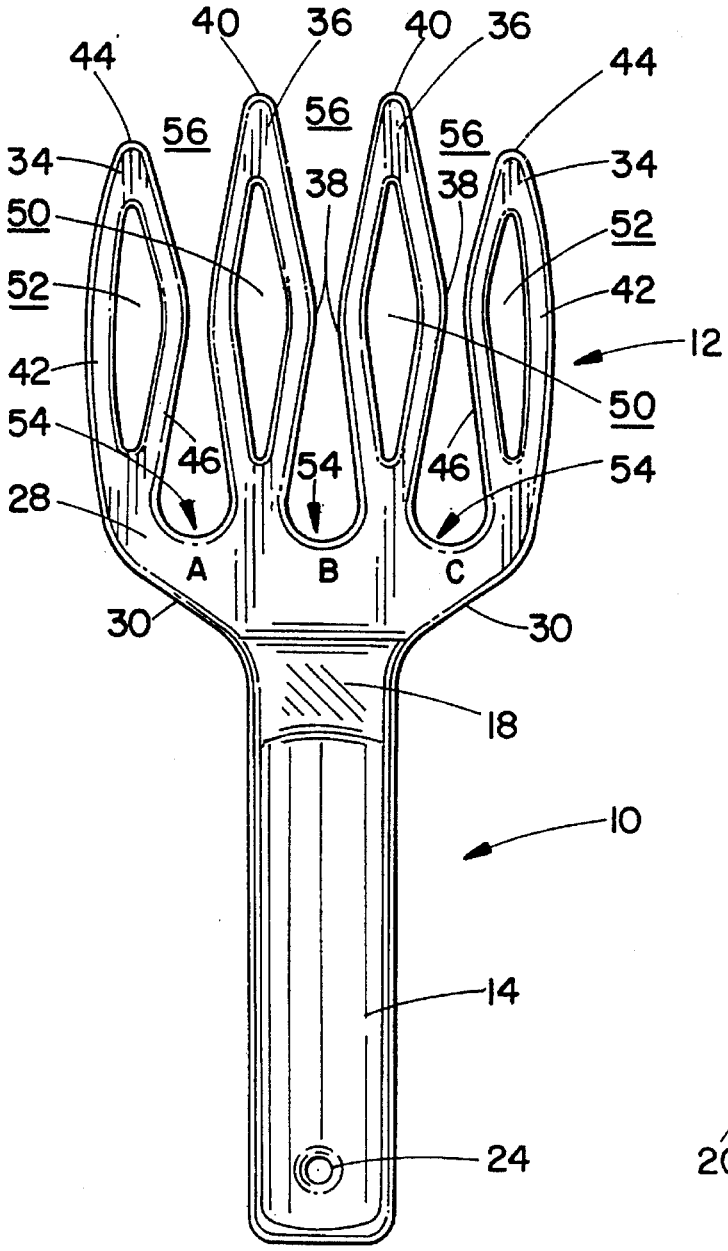
FIG. 2
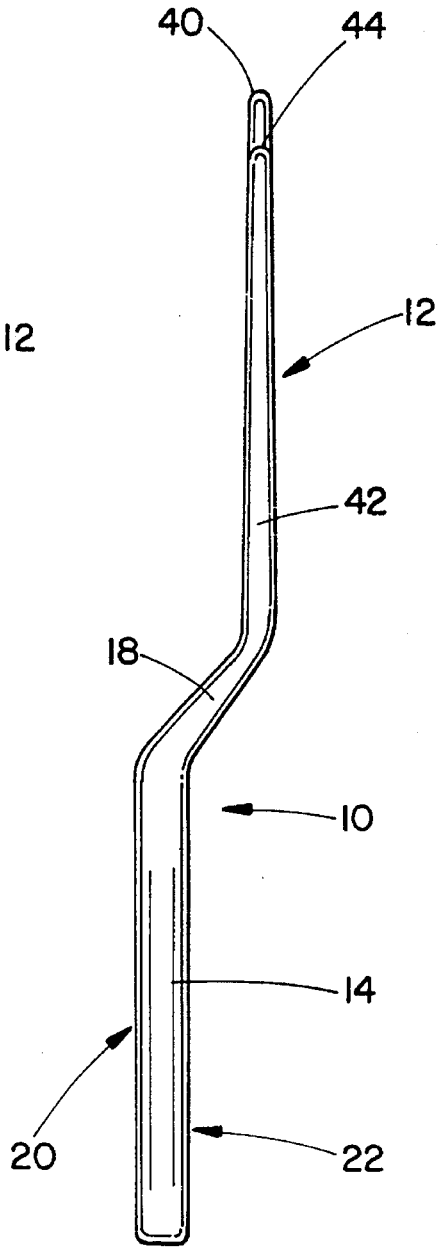
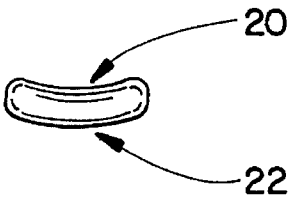
FIG. 3

HAIR BRAIDING DEVICE AND METHOD

BACKGROUND OF THE INVENTION

This invention pertains to the art of hair styling appliances and more particularly to hair weaving appliances. The invention is particularly applicable to a hair braiding device as well as a method for using the hair braiding device, and will be described with particular reference thereto. It will be appreciated, however, that the invention may be advantageously employed in other environments and applications.

Heretofore, one of the only known methods for braiding and weaving hair has been by hand using instructions that are difficult for many to understand. Professional and amateur hairstylists have engaged in using their hands and fingers to separate and weave hair into various braided fashions. The use of hands and fingers can become cumbersome when braiding hair into fancy designs. Also, it is difficult to instruct people, particularly non-professional hairstylists, to braid hair using the prior methods of dividing using hands and fingers.

It has, therefore, become desirable to develop a device or instrument for accomplishing the braiding or weaving of hair by professional hairdressers and the uninitiated. It has also become desirable to develop a method for braiding hair which is easy to teach and to use.

The present invention contemplates a hair braiding device and method which overcome all of the above referred problems and others. The invention provides for a hair braiding appliance which is economical and simple to use.

BRIEF DESCRIPTION OF THE INVENTION

In accordance with the present invention, there is provided a device or tool for braiding hair and a method for using the device to weave or braid hair. The tool comprises a handle that is angled to a flat surface. The handle spreads into four tines, forming three slots. A user is instructed to place portions of hair into the slots in a sequence which results in a finished braid. That is, the unit is held in one hand while segments of hair are placed in designated slots. The braided hair pushes the tool toward the end of the length of hair. The procedure simplifies and enhances the finished hairstyle.

In accordance with a more limited aspect of the invention, a hair braiding device comprises an elongated handle member that gently terminates into a comb base. A plurality of spaced fingers or tines extend in substantially parallel relation to one another outwardly from the comb base. Each of the tines includes a converging or narrowing cross section at its distal end. The width of each tine is greatest about its midsection. The tines define a plurality of generally U-shaped hair receiving slots. The shape of each slot generally converges adjacent the midsection of the tines, serving to retain any hair received in the hair receiving slot.

A principle advantage of the invention is that it provides a simple tool or device for use in the braiding and weaving of hair. Professional and amateur hairstylists may be easily taught to braid hair using the device and achieve desired finished looks.

Another advantage of the present invention is the uncomplicated structure of the device which lends to simple and economical molding during manufacture.

Still other advantageous and benefits of the invention will become apparent to those skilled in the art upon a reading and understanding of the following detailed description.

BRIEF DESCRIPTION OF DRAWINGS

The invention may take physical form in certain parts and arrangement of parts, a preferred embodiment of which will be described in detail in this specification and illustrated in the accompanying drawings which form a part hereof.

FIG. 1 shows a plan view of a hair braiding device in accordance with the present invention.

FIG. 2 is a side elevational view of the hair braiding device of the present invention.

FIG. 3 is an end view of the handle member of the device.

DETAILED DESCRIPTION OF THE PREFERRED EMBODIMENTS

Figure 4:
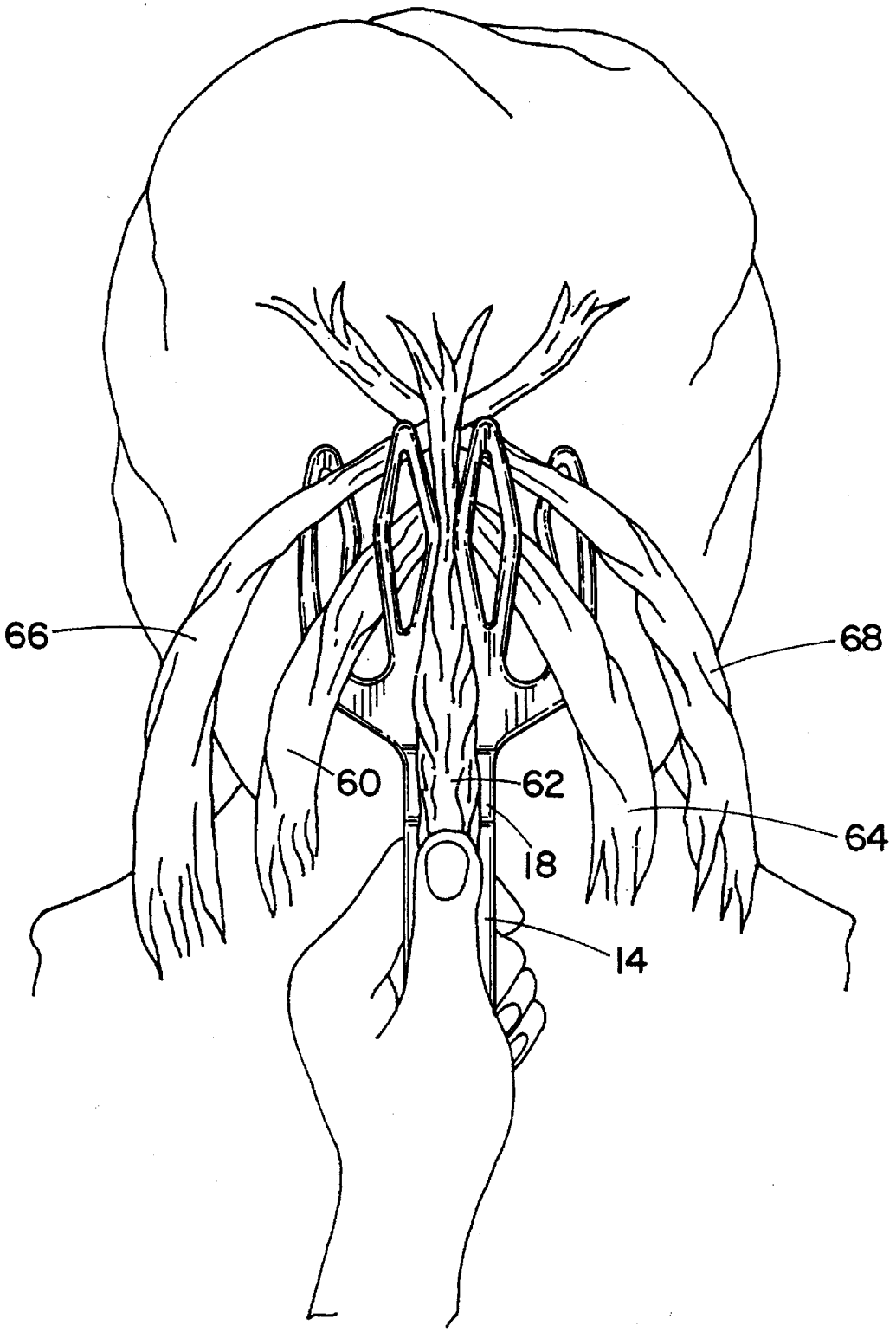
FIG. 4 shows the device of the present invention as it is being used to braid hair.

A number of different braiding styles may be achieved using the present invention. Examples include, but are not limited to, the various English, Dutch and French style braids as well as the underbraid style. The device provides a hairstylist with a tool for applying a braid. It acts as an "extra" hand that is often needed for achieving braids according to a number of known braiding techniques.

With reference now to the drawings wherein the showings are for purposes of illustrating the preferred embodiment of the invention only and not for purposes of limiting same, the figures show a hair braiding device which includes a handle, a comb base and a plurality of fingers or tines which define a series of slots.

FIGS. 1–3 show three views of the hair braiding device of the present invention. The device includes an elongated handle 10 and a weaving area 12. The handle 10 is generally defined by a gripping portion 14 and a thumb rest portion or ramp 18. As will be noted from FIG. 3, an upper surface 20 of the gripping portion of the handle member is depressed or curved downward. The downward curve or groove extends generally along the entire length of the gripping portion. Similarly, lower surface 22 of the gripping portion is convex or curved outward along its length, substantially paralleling the upper depressed surface. The concave upper surface is a desirable feature which offers a user a depression for resting a thumb and a place to ease the grasping of hair. The convex lower surface provides a user with a comfortable grip. The underside 22 of the handle generally rests against the palm of the hand when being used. The gripping portion of the handle defines a through hole 24 which may be used to store the device on a small peg or to receive a string or other device therethrough for keeping or storage.

The thumb rest portion 18 of the handle slopes gently downward away from the gripping portion and terminates in a comb base 28 section of the weaving area 12. Either the thumb rest 18 or the gripping portion 14 may be used to rest the thumb and grasp hair during use of the device. The thumb rest causes the handle gripping portion 14 and the weaving area 12 to be in separate planes so that during use, an underside of weaving area 12 can be placed flatly against a head or other hair base and allow room for a hand or finger to completely and comfortably wrap around the handle.

The comb base is generally perpendicular to the elongated handle. As shown in the figures, the back edges 30 of the comb base are slightly angled away from the handle member. The angle at which the comb base back edges relate to the handle member may vary. For example, it is within the scope of the invention that the back edges of the back edges of the comb base be perpendicular to the handle 10.

With attention still directed to FIG. 1, it will be noted that there are four fingers or tines which extend in parallel relation to one another. The tines extend from comb base 28. The drawing shows two outer tines 34 and two inner tines 36. Inner tines 36 are longer than outer tines 34. The inner tines have a generally elongated diamond shape. The outer walls diverge as they extend from the comb base to their widest point at their respective midsections 38, and then converge to a curved point 40 at their distal ends. The outer tines 34 are mirror images of one another. The respective outer walls 42 extend from extreme edges of the comb base slightly curving or angling outward and then gently curving toward outer tine distal end 44. The inner walls 46 of the outer tines angle away from the outer wall 42 toward the midsection 38 of inner tines 36 and then converge with the outer wall 42 to form a curved point at the outer tine distal end 44.

Each tine defines an oblong opening, denoted as 50 or 52, which offers several advantages. The openings reduce the amount of polymer material which must be used during molding, adding to the economy of the product. Also, the openings offer flexibility to each tine as well as spaces for passing hair for undisclosed styles.

Although the tines and slots are shown as being curved, its is fully within the scope of the invention that the walls defining the tines and slots be linear.

The tines 34 and 36 together define slots A, B and C. The slots each include a curved end defined by the tines and comb base. As discussed, the tines increase in thickness substantially adjacent a midsection of each said tine, causing slots A, B and C to become somewhat narrow at the same midregion. The curved distal ends 40, 44 of the tines define a series of openings 56 to slots A, B and C, respectively, for receiving hair.

When using the device of the present invention, hair is received into slots A, B and/or C, respectively, and is brought to rest on the base or curved terminus 54 of each slot. The hair is further held in place in the respective slots by the tine walls which cause the slots narrow adjacent the midregion of each slot.

FIG. 4 shows the hair weaving device of the present invention in one method of application. The unit is held in one hand while segments of hair are placed in designated slots. The braided hair pushes the tool toward the end of the length of hair.

In one example, a segment of hair from the top of a head is passed through openings 56 and received in the three hair receiving slots A, B and C by passing the device up through the segment. This segment of hair is divided into three parts designated 60, 62 and 64 in FIG. 4. A section 66 of hair from the top right side of the head or hair base is crossed over and into slot A to the bottom or terminus of the slot. The hair is secured over the front of the device using a thumb. Thereafter, a second section of hair 68 from a top left side of the head is crossed over into slot C. The hair is pushed to the bottom of the slot and secured over the front of the device using a thumb. Next, though not shown in the figures, a third section of hair from the right side of the hair base may be passed through slot B. A fourth section of hair from the left side of the hair base is then passed through slot B. These steps are repeated (i.e. a section of hair from the top right side of the heat is crossed into slot A; the hair is secured; a section of hair from the top left side of the head is inserted into slot c; the hair is pushed to the bottom of the slot and secured; a section of hair from the right side of the hair is passed through slot B; and a section of hair from the left side of the hair base is passed through slot B) until a braid is formed. The braid may then be tied off using a rubber band or the like. In using the device, it should be noted that pushing hair to the bottom of the slots causes the tool to move down the head.

Another example of using the hair weaving device of the present invention calls for turning a head of hair upside down. The device is then placed at the nape of the neck and weaving is accomplished in the manner described above. The device may also be used on the sides of the head to form various styles. There are styles which do not require all three slots. Hair may be woven through two of the three slots, for example.

It is within the scope of this invention to include fewer than four tines or greater than four tines. It is further within the scope of the invention for the tines to be staggered in different planes, or to be less smooth or jagged along their outer edges.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

I claim:

1. A hair braiding device, comprising:

an elongated handle member gently terminating in a comb base, a plurality of spaced tines extending in substantially parallel relation to one another outwardly from said comb base, each said tine having a converging cross section at its distal end, a width of each tine being greatest at its midsection, said tines defining a plurality of generally U-shaped hair receiving slots, said slots being generally converging adjacent the midsection of each tine for holding hair received in each said hair receiving slot, wherein the handle member includes a gripping portion and a thumb rest portion, the thumb rest portion sloping gently away and downward from the gripping portion and merging into the comb base.

2. A hair braiding device, comprising:

an elongated handle member gently terminating in a comb base, a plurality of spaced tines extending in substantially parallel relation to one another outwardly from said comb base, each said tine having a converging cross section at its distal end, a width of each tine being greatest at its midsection, said tines defining a plurality of generally U-shaped hair receiving slots, said slots being generally converging adjacent the midsection of each tine for holding hair received in each said hair receiving slot, wherein the handle member includes a gripping portion having a slightly concave upper surface and a slightly convex lower surface, the gripping portion easing into a thumb rest portion sloped away from the gripping portion and merging into the comb base.

3. A method for braiding hair, comprising the steps of:

providing a hair braiding device which includes a plurality of tines extending outward from a comb base in substantially parallel relation to define a series of hair receiving slots;

holding an initial section of hair away from a hair base;

passing the tines of the hair braiding device through the initial section of hair adjacent the hair base such that portions of the initial section of hair rest in the hair receiving slots;

passing a first segment of hair different from the hair in the initial section through a first hair receiving slot;

passing a second segment of hair different from the hair in the initial section through a second hair receiving slot; and forming a braid.

4. A method for braiding hair, comprising the steps of:

holding a segment of hair generally outwardly away from a hair base;

passing fingers of a hair weaving device through the segment of hair that is being held generally outwardly away from the hair base, the hair weaving device comprising a handle member gently terminating in a comb base and four spaced tines in substantially parallel relation which define hair receiving slots A, B and C such that slot A is to the left of slot B and slot B is to the left of slot C;

passing a first section of hair extending from a right side of the hair base through slot A; and passing a second section of hair extending from a left side of the hair base through slot C.

5. A method for braiding hair, according to claim 4, including the additional steps of:

passing a third section of hair from the right side of the hair base through slot B;

passing a fourth section of hair from the left side of the hair base through slot B; and forming a braid.

* * * * *